US007564333B2

(12) United States Patent
Molteni

(10) Patent No.: US 7,564,333 B2
(45) Date of Patent: Jul. 21, 2009

(54) MAGNETIC SEPARATOR WITH FERRITE AND RARE EARTH PERMANENT MAGNETS

(75) Inventor: Danilo Molteni, Manerbio BS (IT)

(73) Assignee: SGM Gantry S.p.A., Manerbio (IT)

( * ) Notice: Subject to any disclaimer, the term of this patent is extended or adjusted under 35 U.S.C. 154(b) by 0 days.

(21) Appl. No.: 10/577,407

(22) PCT Filed: Nov. 7, 2003

(86) PCT No.: PCT/IT03/00726

§ 371 (c)(1),
(2), (4) Date: Apr. 2, 2007

(87) PCT Pub. No.: WO2005/044461

PCT Pub. Date: May 19, 2005

(65) Prior Publication Data

US 2007/0279170 A1 Dec. 6, 2007

(51) Int. Cl.
*H01F 7/02* (2006.01)

(52) U.S. Cl. ..... 335/306; 335/153; 335/179; 335/207; 335/222; 335/229; 335/288; 335/302

(58) Field of Classification Search ..... 335/153, 335/179, 207, 222, 229, 288, 302, 206
See application file for complete search history.

(56) References Cited

U.S. PATENT DOCUMENTS

| | | | | |
|---|---|---|---|---|
| 2,992,738 | A * | 7/1961 | Maynard | 209/223.1 |
| 3,168,464 | A * | 2/1965 | Ferris et al. | 209/223.1 |
| 3,389,794 | A * | 6/1968 | Miyata | 209/219 |
| 3,737,822 | A * | 6/1973 | Buus et al. | 335/304 |
| 3,784,945 | A | 1/1974 | Baermann | |
| 4,419,644 | A * | 12/1983 | Baermann | 335/288 |
| 4,575,702 | A * | 3/1986 | Nitta et al. | 335/286 |
| 4,638,281 | A * | 1/1987 | Baermann | 335/303 |
| 4,769,130 | A * | 9/1988 | Christensen | 209/223.1 |
| 4,781,821 | A * | 11/1988 | Salmi | 209/214 |
| 5,092,986 | A * | 3/1992 | Feistner et al. | 209/212 |
| 6,104,271 | A | 8/2000 | Barrett | |
| 6,149,014 | A | 11/2000 | Mankosa et al. | |
| 6,421,519 | B1 * | 7/2002 | Yamashita et al. | 399/277 |
| 6,850,140 | B1 * | 2/2005 | Gleckner | 335/306 |
| 7,049,919 | B2 * | 5/2006 | Yamaki | 335/288 |
| 2003/0196935 | A1 | 10/2003 | Miles et al. | |

* cited by examiner

*Primary Examiner*—Elvin G Enad
*Assistant Examiner*—Mohamad A Musleh

(57) ABSTRACT

A magnetic separator with permanent magnets includes a ferromagnetic member (2) for the circuit connection between at least two magnetic poles (3C) made up of ferrite magnets (12) in the bottom portion in contact with said ferromagnetic member (2) for the circuit connection, and of rare earth magnets (13) in the top portion that represents the entrance/exit surface (14) of the magnetic flux lines (15, 16). The ratio between the effective magnetic length of the ferrite magnets (12) and of the rare earth magnets (13) is preferably 2:1, and the preferred materials are strontium ferrite for the former and iron-boron-neodymium for the latter. In this way it is possible to combine the magnetic characteristics of the two types of permanent magnets so as to make them complementary and thus enhance the attractive effectiveness of the separator both for ferromagnetic materials with high or low shape factor, and for materials with high or low and sometimes very low permeability.

8 Claims, 2 Drawing Sheets

MAGNETIC SEPARATOR WITH FERRITE AND RARE EARTH PERMANENT MAGNETS

This patent application claims the benefit of priority from PCT application Ser. No. PCT/IT2003/000726 filed Nov. 7, 2003, the contents of which are incorporated herein by reference.

The present invention relates to magnetic separators with permanent magnets, and in particular to a separator provided with permanent magnets made of ferrite and rare earth elements, capable of enhancing and optimizing the attraction effect of variably ferromagnetic materials. The present application specifically refers to a pulley separator, but it is clear that what is said also applies to other types of magnetic separators (drums, plates, belts, etc.) which can be provided with the permanent magnets described herein.

BACKGROUND OF THE INVENTION

It is known that magnetic separators are used in all those applications where it is necessary to attract and separate ferromagnetic materials of any shape and size from mixed material. The attractive capacity of the separator depends both on the magnetic field that it can generate (strength and gradient), and on the intrinsic induction of the object to be separated as it results from its shape factor (e.g. the sphere has the worst shape factor) and from its degree of permeability.

Attractive circuits (i.e. permanent magnets) made of ceramic materials such as barium ferrite, and even better strontium ferrite, are known since more than forty years. These magnets have a medium intrinsic and residual magnetic energy, and are capable of attracting within a certain distance ferromagnetic materials with high shape factor and/or medium-high permeability.

Other attractive circuits made of sintered materials with high intrinsic residual magnetic energy, known as rare earth elements (samarium-cobalt, iron-boron-neodymium), have been in use more recently, in the last 15-20 years. These magnets can attract within a relatively short distance, yet with great effectiveness, even materials with low shape factor and/or medium-low and very low permeability. Their effectiveness is however concentrated within few tens of millimeters.

SUMMARY OF THE INVENTION

Therefore the object of the present invention is to provide a magnetic separator which overcomes the limitations of known separators. This object is achieved by means of a separator in which each magnetic pole is made up of ferrite magnets in the bottom portion in contact with the ferromagnetic member for the circuit connection between the poles, and of rare earth magnets in the top portion that represents the entrance/exit surface of the magnetic flux lines.

The main advantage is that of combining the magnetic characteristics of the two types of permanent magnets, described above (ferrite and rare earth) so as to make them complementary and thus enhance the attractive effectiveness both for ferromagnetic materials with high or low shape factor, and for materials with high or low and sometimes very low permeability.

In this way the attractive range of these magnets is greatly amplified and the separator with rare earth magnets, and with a quality of separation very high with respect to a medium-low effectiveness of a similar separator with ferrite magnets.

Another significant advantage comes from the very simple structure of said attractive circuits, which result easy to manufacture and to apply to any kind of separator.

BRIEF DESCRIPTION OF THE DRAWINGS

Further advantages and characteristics of the separator according to the present invention will be clear to those skilled in the art from the following detailed description of an embodiment thereof, with reference to the annexed drawings wherein.

DETAILED DESCRIPTION OF THE PREFERRED EMBODIMENT

Figure 1:
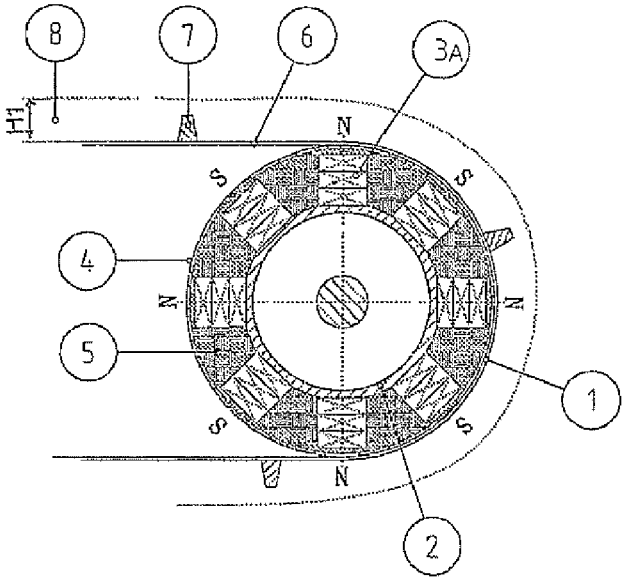
Fig.1 (PRIOR ART)
FIG. 1 is a cross-sectional view of a prior art pulley separator with ferrite magnets.

With reference to FIG. 1, there is seen that a permanent magnet pulley 1 essentially consists of a ferromagnetic cylinder 2 around which there are applied ferrite magnetic masses 3A, said cylinder 2 being enclosed by a protective casing 4 of non-magnetic material (e.g. stainless steel) that is preferably filled with a blocking resin 5. This assembly is secured through end flanges onto a driving or idle shaft, so that it can be preferably used as driving roller for a conveyor 6 provided with slats 7 on which the material 8 to be treated is drawn.

The dimension H1 indicates the effective working height with respect to the layer of material 8 to be treated, and an indicative value for a pulley of 400 mm in diameter is H1≅80-90 mm for ferromagnetic parts with medium-high shape factor and good permeability.

Figure 2:
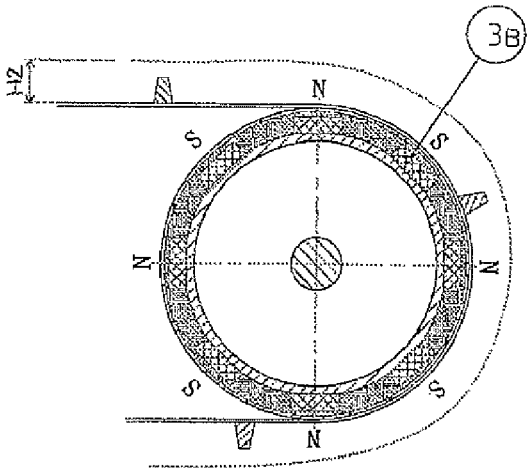
Fig.2 (PRIOR ART)
FIG. 2 is a cross-sectional view of a prior art pulley separator with rare earth magnets.

In FIG. 2 there is illustrated a pulley similar in shape and size to the one above, with magnetic masses 3B of rare earth elements, in which the working height H2 is 40-50 mm for ferromagnetic parts with medium-low shape factor and low permeability, and within 30 mm of distance from the active surface for parts with very low permeability.

Figure 3:
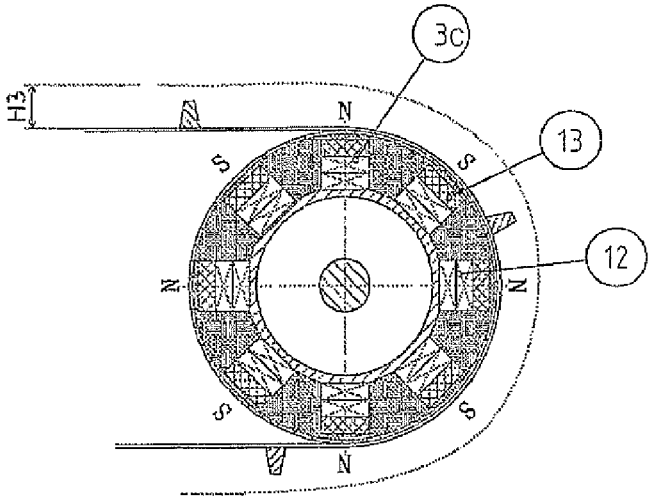
FIG. 3 is a cross-sectional view of a pulley separator with ferrite and rare earth magnets according to the present invention.

In FIG. 3 there is illustrated a pulley similar in shape and size to the ones above, with mixed magnetic masses 3C according to the present invention, where for merely exemplificative purposes there are used in particular in each pole two ferrite blocks 12 about 25 mm high located in contact with the ferromagnetic cylinder 2 and one rare earth block 13 also about 25 mm high placed on top of and in contact with the ferrite blocks 12 and close to the non-magnetic casing 4.

Figure 4:
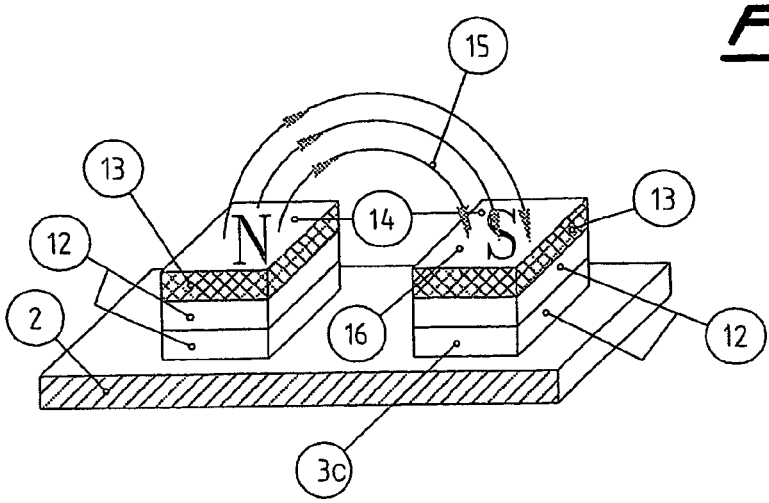
FIG. 4 is an enlarged diagrammatic view showing in detail the structure of an attractive circuit according to the present invention.

In the detail of FIG. 4 there is illustrated a permanent magnet circuit according to the present invention including at least two poles 3C North-South each of which is made up in the bottom portion, in contact with the ferromagnetic cylinder 2 for the circuit connection between the poles, of ferrite magnets 12 (preferably strontium ferrite) and in the top portion that represents the exit surface 14 of the magnetic flux lines 15 when North pole, or entrance surface 16 when South pole, of rare earth magnets 13 (preferably iron-boron-neodymium) capable of increasing the values of the magnetic field and in particular of the magnetic field gradient.

Figure 5:
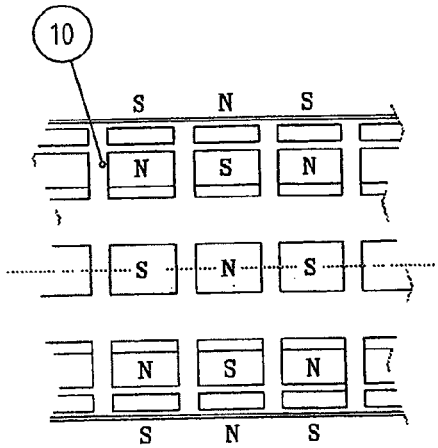
FIG. 5 is a partial plan view of a first possible arrangement of the polarities for the separator of FIG. 3.
Figure 6:
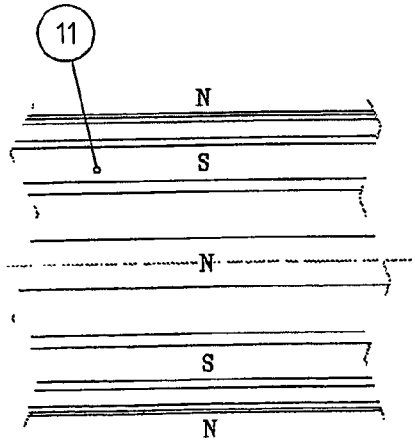
FIG. 6 is a partial plan view of a second possible arrangement of the polarities for the separator of FIG. 3.

In FIGS. 5 and 6 there are illustrated for exemplificative purposes two possible polarities arrangements in the longitudinal direction for magnetic pulleys; in particular, FIG. 5 shows a chequered arrangement of the various North-South magnetic poles 10 whereas FIG. 6 shows the arrangement with longitudinal alternate rows of North-South polarities 11.

For a comparison between the indicative field and field gradient values that can be obtained in the three separators above, reference is made to the following table. In this table, D is the distance at which the magnetic field is measured, while G is the field gradient measured over the specified distance interval.

| DISTANCE AND GRADIENT | FERRITE | RARE EARTH | FERRITE + RARE EARTH |
|---|---|---|---|
| D = 10 mm (Öe) | 1015 | 2000 | 2500 |
| G over 10-20 mm (Öe/cm) | 245 | 820 | 900 |
| D = 20 mm (Öe) | 770 | 1180 | 1600 |
| G over 20-30 mm (Öe/cm) | 150 | 510 | 500 |
| D = 30 mm (Öe) | 620 | 670 | 1100 |
| G over 30-40 mm (Öe/cm) | 120 | 310 | 300 |
| D = 40 mm (Öe) | 500 | 360 | 800 |
| G over 40-50 mm (Öe/cm) | 90 | 160 | 240 |
| D = 50 mm (Öe) | 410 | 200 | 560 |
| G over 50-60 mm (Öe/cm) | 60 | — | 160 |
| D = 60 mm (Öe) | 350 | — | 400 |
| G over 60-70 mm (Öe/cm) | 50 | — | 120 |
| D = 70 mm (Öe) | 300 | — | 280 |
| G over 70-80 mm (Öe/cm) | 50 | — | 80 |
| D = 80 mm (Öe) | 250 | — | 200 |
| G over 80-90 mm (Öe/cm) | 40 | — | 50 |
| D = 90 mm (Öe) | 210 | — | 150 |

This novel type of attractive circuit applied, for a comparative example, to the above-mentioned pulley thus surprisingly allows to enhance the characteristics of the two types of magnets at the distances where they are less effective, yet retaining their advantageous characteristics in the zones where they better work individually.

This results clearly from the possibility of having a better performance in the zone beyond 50 mm of distance from the active surface, thanks to the higher gradient, with respect to the ferrite magnet pulley that has trouble with poorly magnetizable materials; and similarly this results from the possibility of having a significantly improved average performance in the zone within 50 mm, thanks to the stronger field, with respect to the similar rare earth magnet pulley.

It is clear that the above-described and illustrated embodiment of the magnetic separator according to the invention is just an example susceptible of various modifications. In particular, the ratio between the effective magnetic length of ferrite and rare earth elements in each pole may be different from the above-illustrated 2:1 ratio, indicatively between 1:1 and 3:1, and obviously the number, shape and arrangement of the magnets poles can be freely changed according to the needs.

The invention claimed is:

1. Magnetic separator with permanent magnets comprising:

a ferromagnetic member (2);

at least two distinct magnetic poles (3C), each magnetic pole located on said ferromagnetic member (2) and in circuit connection with said ferromagnetic member;

wherein each distinct magnetic pole (3C) comprises ferrite magnets (12) in the bottom portion in contact with said ferromagnetic member (2) for the circuit connection, and rare earth magnets (13) in the top portion to provide a distinct entrance/exit surface (14, 16) of magnetic flux lines (15) wherein in each magnetic pole (3C) the ratio between the effective magnetic length of the ferrite magnets (12) and of the rare earth magnets (13) is between 1:1 and 3:1.

2. Magnetic separator according to claim 1, characterized in that in each magnetic pole (3C) the ratio between the effective magnetic length of the ferrite magnets (12) and of the rare earth magnets (13) is 2:1.

3. Magnetic separator according to claim 1 or 2, characterized in that it consists of a ferromagnetic cylinder (2) around which there are applied the magnetic poles (3C), said cylinder (2) being enclosed by a protective casing (4) of non-magnetic material filled with a blocking resin (5), this assembly being secured onto a shaft so that it can be used for a conveyor (6) on which the material (8) to be treated is drawn.

4. Magnetic separator according to claim 1 or 2, characterized in that the ferrite magnets (12) are made of barium ferrite or strontium ferrite.

5. Magnetic separator according to claim 1 or 2, characterized in that the rare earth magnets (13) are made of samarium-cobalt or iron-boron-neodymium.

6. Magnetic separator according to claim 3, characterized in that the ferrite magnets (12) are made of barium ferrite or strontium ferrite.

7. Magnetic separator according to claim 3, characterized in that the rare earth magnets (13) are made of samarium-cobalt or iron-boron-neodymium.

8. Magnetic separator according to claim 4, characterized in that the rare earth magnets (13) are made of samarium-cobalt or iron-boron-neodymium.

* * * * *